United States Patent [19]

Balzer

[11] Patent Number: 4,577,081

[45] Date of Patent: Mar. 18, 1986

[54] HEATING NONMAGNETIC METAL WORKPIECES

[75] Inventor: Norbert R. Balzer, Boaz, Ala.

[73] Assignee: Park-Ohio Industries, Inc., Shaker Heights, Ohio

[21] Appl. No.: 602,542

[22] Filed: Apr. 20, 1984

[51] Int. Cl.[4] ..... H05B 5/00; H05B 6/64

[52] U.S. Cl. ..... 219/10.69; 219/390; 219/10.71; 219/10.41; 164/462

[58] Field of Search ..... 219/390, 10.69, 10.41, 219/10.43, 10.47, 10.57, 10.75; 164/122.2, 462; 75/3, 37; 419/28, 45

[56] References Cited

U.S. PATENT DOCUMENTS

| | | | |
|---|---|---|---|
| 3,715,556 | 2/1973 | Balzer et al. | 219/10.69 |
| 4,159,415 | 6/1979 | Williams | 219/390 |
| 4,356,861 | 11/1982 | Winter | 164/462 |

*Primary Examiner*—C. L. Albritton
*Assistant Examiner*—M. M. Lateef
*Attorney, Agent, or Firm*—Body, Vickers & Daniels

[57] ABSTRACT

Method and apparatus for heating a billet of nonmagnetic metal material to forging temperature by first preheating the billet in a high efficiency slot-type electric radiant heat furnace to a preheat temperature a substantial level below the forging temperature, and then conveying the preheated billet from the furnace immediately into an inductive heating coil and energizing the coil to inductively post-heat the billet to the forging temperature.

11 Claims, 5 Drawing Figures

FIG. 4
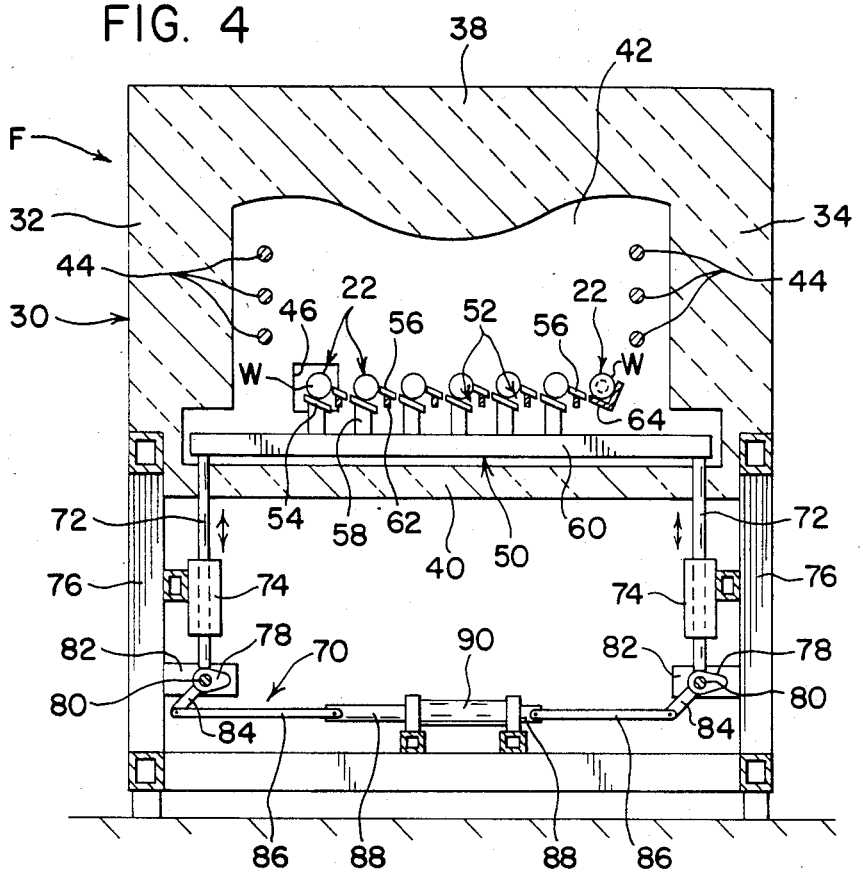
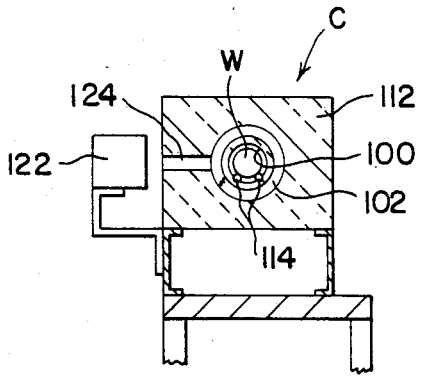
FIG. 5

HEATING NONMAGNETIC METAL WORKPIECES

BACKGROUND OF THE INVENTION

The present invention relates, in general, to method and apparatus for heating metal articles of nonmagnetic material to an elevated processing or forging temperature.

In the metal forging art, the customary methods heretofore employed for heating metal billets or workpieces of nonmagnetic material such as brass or copper to their forging temperatures of around 1500° F. has been by the use of either a gas-fired or an electrically heated furnace in which the billets are heated. In these prior heating methods, however, the nonmagnetic material of the billets is subjected to the high (1500° F.) furnace temperature for the entire time that they are within the confines of the furnace. As a result, the nonmagnetic billets encounter objectionable surface degradation or grain coarsening due to the extended period of time they are exposed to the high furnace temperatures.

Although such surface degradation or grain coarsening of the nonmagnetic billets could be substantially eliminated or greatly minimized by the use of induction heating to heat the billets to their forging temperature of approximately 1500° F., such inductive heating of the billets is considerably less efficient than a high efficiency electric radiant heat furnace such as the slot-type furnace disclosed, for example, in U.S. Pat. No. 4,159,415 to Williams. Normal efficiencies of induction heating of articles of brass or other nonmagnetic metal materials is in the order of 30% to 35%, whereas the normal efficiency of heating such articles in a slot-type high efficiency electric radiant heat type furnace is in excess of 60%. For this reason, therefore, the heating of nonmagnetic metal billets to their forging temperature entirely by an inductive heating process has proven economically unfeasible.

SUMMARY OF THE INVENTION

The present invention contemplates a novel method and apparatus for heating nonmagnetic metal articles to an elevated processing temperature which overcomes all of the above-referred to problems and others and provides a heating method and apparatus which not only is of high overall efficiency but which at the same time does not adversely affect the surface condition of the articles.

Briefly stated, in accordance with one aspect of the invention, a slot-type high efficiency electric radiant heat type furnace is used to first preheat the nonmagnetic metal articles to a preheat temperature substantially below their forging temperature, and then an induction heating coil is used to inductively post-heat the preheated articles to their final forging temperature. With such a two-stage heating process, the greater amount of the total energy required to heat the metal articles to their forging temperature is used to effect most of the required heating thereof in a highly efficient manner without adversely affecting the surface condition of the articles by surface degradation or grain coarsening. Moreover, by preheating the nonmagnetic metal articles with a slot-type high efficiency electric radiant heat furnace to the aforementioned preheat temperature and then post-heating the articles with induction heating to their forging temperature, the overall efficiency of the heating system is increased markedly over those systems wherein the articles are heated to their forging temperature entirely by induction heating.

In accordance with a further aspect of the invention, nonmagnetic articles such as brass or copper billets are first preheated to a preheat temperature of around 1200° F. or so within a slot-type high efficiency electric radiant heat furnace such as referred to above, and then are transferred from the furnace immediately into, and inductively post-heated in an induction heating coil to their final forging temperature of around 1500° F. or so.

The principal object of the invention is to provide a novel method of heating nonmagnetic metal articles to an elevated processing temperature which is of high efficiency while substantially avoiding surface degradation or grain coarsening of the article.

Another object of the invention is to provide a method of heating nonmagnetic metal articles to an elevated processing temperature in which the greater amount of the total energy requirement for such purpose is utilized to effect most of the heating of the article in a highly efficient manner but without causing unacceptable surface degradation or grain coarsening of the articles.

Still another object of the invention is to provide a novel two-stage method of heating nonmagnetic metal articles to a selective elevated processing temperature partly by preheating the articles in a high efficiency electric radiant furnace and partly by inductively post-heating the articles to the final processing temperature.

A further object of the invention is to provide a novel method of heating nonmagnetic metal articles to a selective elevated processing temperature which utilizes a combination of preheating of the articles to a preheat temperature below the processing temperature of the articles in a high efficiency electric radiant heat furnace together with inductive post-heating of the preheated articles to the final selective processing temperature.

A still further object of the invention is to provide a novel method of heating nonmagnetic metal articles to an elevated processing temperature which avoids surface degradation or grain coarsening of the articles yet is of markedly increased overall efficiency as compared to the heating of the articles to such processing temperature entirely by induction heating thereof.

Still a further object of the invention is to provide a novel apparatus for heating nonmagnetic metal articles to an elevated processing temperature which is of high efficiency while avoiding surface degradation or grain coarsening of the heated articles.

Further objects and advantages of the invention will appear from the following detailed description of a preferred embodiment thereof and from the accompanying drawings.

BRIEF DESCRIPTION OF THE DRAWINGS

In the drawings:

FIG. 4 is a vertical section taken on line 4—4 of FIG. 2;

FIG. 5 is a vertical section taken on line 5—5 of FIG. 2; and,

DESCRIPTION OF THE PREFERRED EMBODIMENTS

Figure 1:
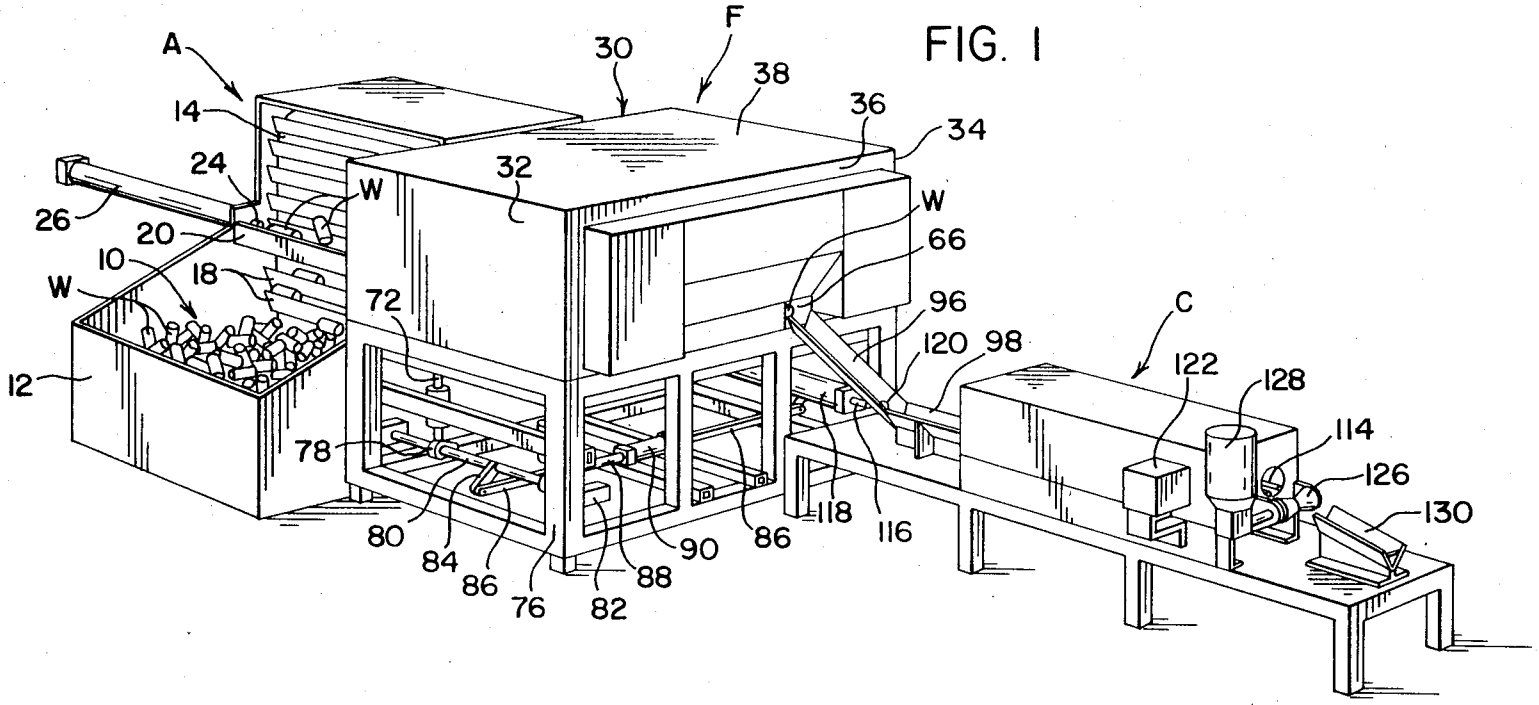
FIG. 1 is a perspective view of a representative apparatus according to the invention for heating nonmagnetic metal articles to an elevated processing temperature by the method comprising the invention.

Referring now to the drawings wherein the showings are for the purposes of illustrating a preferred embodiment of the invention only and not for the purposes of limiting same, the Figures show the invention as embodied in a method and apparatus for heating metal articles of nonmagnetic material, such as billets or workpieces W of brass, copper or aluminum for example, to the forging temperature of the articles preparatory to the production of forgings therefrom. It is to be understood, however, that the invention may be utilized for heating articles of other metallic material to their forging or other elevated temperature wherever it may be found to have suitable utility therefor. For the heating of workpieces W of nonmagnetic metal material such as brass, copper or aluminum to a forgeable condition, they must be heated to a temperature of around 1500° F. or so in the case of brass or copper workpieces or to a somewhat lesser temperature in the case of aluminum workpieces.

Although as mentioned above, the heating of the nonmagnetic metal workpieces to their forging temperature by prior conventional electric furnace heating procedures is far more efficient than the also known inductive heating procedures, the use of an electric furnace for such heating purposes undesirably results in objectionable surface degradation or grain coarsening of the workpiece material due to the extended period of time the workpieces are necessarily exposed to the high temperatures (around 1500° F.) in the furnace.

Figure 6:
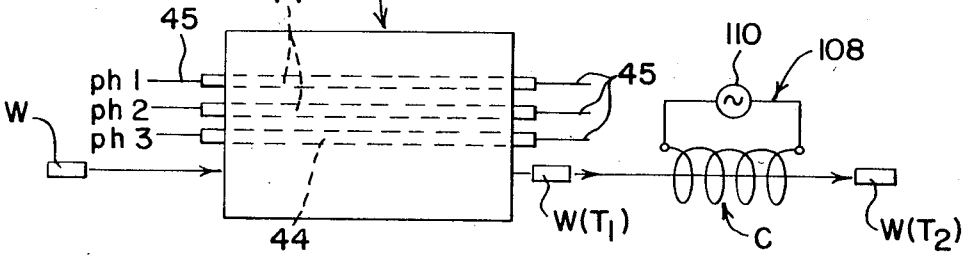
FIG. 6 is a schematic drawing illustrating the successive heating steps comprising the article heating method according to the invention.

Accordingly, to avoid this problem while utilizing to a substantial degree the advantageous high efficiency heating characteristics of a slot-type electric furnace, the workpieces W are, in accordance with the invention and as generally illustrated schematically in FIG. 6, heated to their forging or other elevated processing temperature by a combination of initial preheating in a high efficiency electric furnace F to an elevated preheat temperature to some 200° F. to 300° F. or so below such processing temperature coupled with inductive postheating of the workpieces to their final selective processing temperature $T_2$ in an induction heating coil C. In the case, for example, of brass or copper workpieces W to be forged, they are first preheated to a preheat temperature of around 1200° F. in the high efficiency electric furnace F and then inductively postheated to their selected forging temperature of around 1500° F. in the induction heating coil C.

With the heating system according to the invention, most of the total energy required to fully heat the workpieces W to their final forging temperature is employed to heat the workpieces by the relatively highly efficient radiant heating action of the high efficiency electric radiant heat furnace F. At the same time, the appreciably lower temperature to which the workpieces are preheated in the preheating furnace F (e.g., 1200° F.) and the consequent appreciably shorter time period during which the workpieces need be exposed to the lesser preheat temperature in the furnace F in order to raise them to their preheat temperature rather than to their much higher final processing or forging temperature results in the practical elimination of undesirable surface degradation or grain coarsening of the workpiece material. For the purposes of the invention, the electric furnace F may be any suitable so-called high efficiency type electric furnace such as, for instance, the slot-type electric radiant heat furnace disclosed in the aforementioned U.S. Pat. No. 4,159,415.

By first preheating the workpieces W to a lesser temperature than their final processing or forging temperature in a high efficiency type electric radiant heat furnace F, and then inductively post-heating the workpieces to their final selective processing or forging temperature in an induction heating coil C, the overall efficiency of the total heating system is markedly increased over heating systems in which the workpieces are heated to their processing or forging temperature entirely by an induction heating process, such as have been employed in the past because of their efficacy in avoiding the objectionable surface degradation or grain coarsening of the nonmagnetic metal workpieces which is characteristic of long duration electric furnace heating processes. Normal efficiencies of induction heating processes for heating brass or other nonmagnetic metal workpieces W to forging temperature are in the range of 30% to 35%. In contrast, combining a preheat of such workpieces in a high efficiency electric radiant heat type furnace F to a preheat temperature well below the forging temperature with post-heating of the workpieces by high frequency inductive heating to the forging temperature results in an appreciably increased efficiency for the overall heating system amounting to around 60%, thereby realizing an approximately 50% savings in electric energy.

Referring now to FIGS. 1-5 which illustrate generally an apparatus for carrying out the novel method comprising the invention for heating nonmagnetic metal workpieces to an elevated processing temperature such as their forging temperature $T_2$, a feed means A is adapted to feed workpieces W from a supply or pile 10 thereof in a hopper 12 into the high efficiency electric radiant heat furnace F such as the slot-type furnace disclosed in U.S. Pat. No. 4,159,415. The nonmagnetic metal workpieces W, in the particular case illustrated, are in the form of comparatively short lengths of brass or copper rod.

Figure 2:
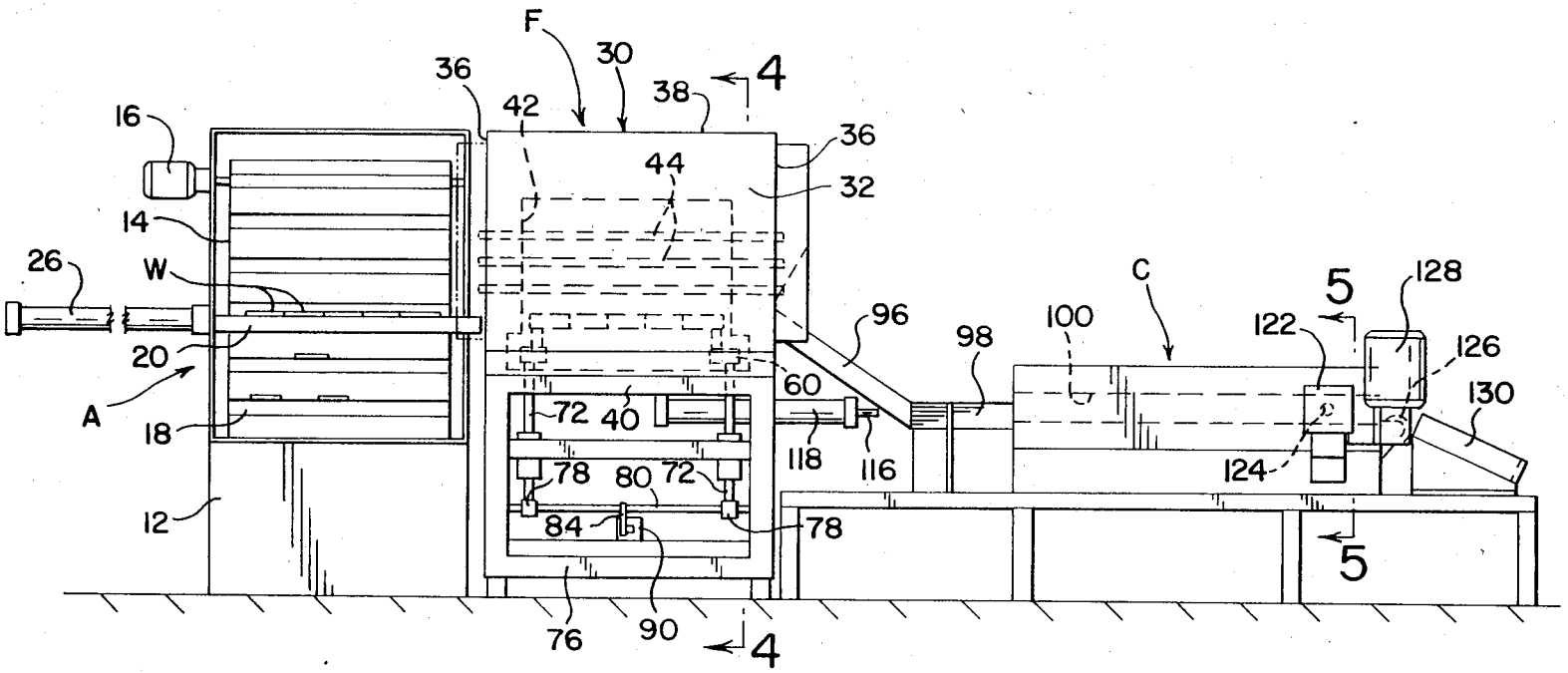
FIG. 2 is a front elevation of the apparatus shown in FIG. 1.
Figure 3:
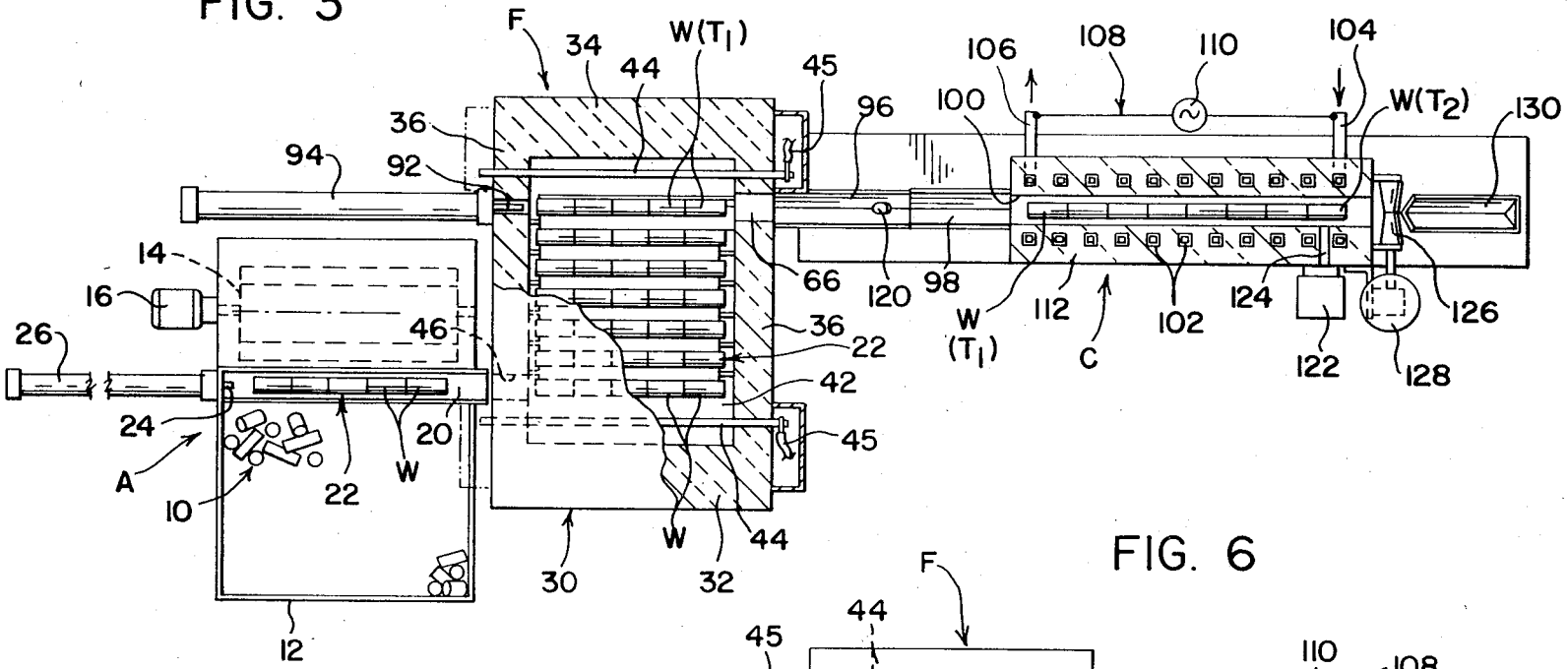
FIG. 3 is a plan view of the apparatus shown in FIG. 1 with the electric furnace and induction heating coil components thereof respectively shown partly broken away in section and in full section.

The workpiece feed means A may comprise a vertically movable endless conveyor belt 14 continuously driven by an electric motor-speed reducer unit 16 and provided with a plurality of horizontally extending lift troughs 18 which, during their upward travel, pass through the supply 10 of workpieces in the hopper 12 to pick up one or more of the workpieces and deposit them, as by tilting of the troughs 18, into a stationary horizontally extending feed-in trough 20 and eventually fill the latter with a plurality or row 22 of the workpieces, as shown in FIGS. 2 and 3. Any excess workpieces discharged from a lift trough 18 onto workpieces already present in and filling the feed trough 20 simply fall back down into the supply hopper 12.

The row 22 of workpieces W filling the feed trough 20 is fed or pushed into the furnace F, when ready to receive the same, by a push rod which may comprise the piston rod 24 of a hydraulic cylinder 26 which is intermittently actuated by suitable control means (not shown). Actuation of the cylinder 26 by the control means causes the piston rod 24 to push the row 22 of workpieces from feed trough 20 into the furnace F through which they are then advanced to preheat them progressively to the aforementioned preheat temperature $T_1$ of, for example, around 1200° F. or so. The actuation of the hydraulic cylinder 26, by the control means therefor, occurs whenever the furnace F is in a ready condition for receiving the row 22 of workpieces from the feed trough 20 as determined, for example, by a suitable electric signal to a solenoid operated control valve (not shown) of the control means that regulates the operation of the cylinder 26.

The furnace F is shown generally as comprising a fire resistant housing 30 formed by vertical extending front, rear, and side walls 32, 34 and 36, respectively, and top and bottom walls 38 and 40, which walls all define a heating chamber 42 through which the workpieces are conveyed to effect the progressive preheating thereof to the preheat temperature $T_1$. A plurality of elongated rod or bar-shaped electrical resistance heating elements 44 made of silicon carbide elements, for example, are mounted within the chamber 42 to heat and maintain it at the aforementioned workpiece preheat temperature $T_1$ of around 1200° F. A plurality (three in the particular case shown) of the heating elements 44 extend horizontally in vertically spaced relation to each other and in inwardly spaced parallel relation to each of the front and rear walls 32 and 34 of the furnace housing 30. The heating elements extend through the refractory lined walls 36 of the housing to the outside of the furnace where they are connected, as by circuit leads 45 (FIG. 3) to a suitable source of electrical power (not shown), e.g., one to each phase of a three-phase 60 Hz source of a suitable voltage such as 480 volts, as denoted in FIG. 6 by the three circuit phases ph1, ph2 and ph3 of the power circuit.

On feeding of the row 22 of workpieces W from the feed trough 20 into the furnace F by the piston rod 24 of hydraulic cylinder 26, the workpieces are pushed through an opening 46 (FIGS. 3 and 4) in the furnace side wall 36 onto a step-by-step workpiece transport mechanism 50 in the furnace chamber 42 for advancing each row 22 of the workpieces in a step-by-step manner therethrough. As shown particularly in FIG. 4, the transport mechanism 50 comprises a series of successive parallel support cradles 52 for supporting therein successive rows 22 of the workpieces W and advancing each row from one support cradle to the next. The cradles 52 are comprised of alternate horizontally extending vertically movable and rearwardly declining parallel rest bars 54 and alternate horizontally extending rearwardly declining and fixed parallel stop bars 56. The workpieces W rest on the movable rest bars 54 and against the longitudinal side edges of the fixed bars 56. The vertically movable rest bars 54 are all supported at each end on respective supports 58 upstanding from a pair of parallel side lift bars 60 extending horizontally within the lowermost region of the furnace chamber 42 alongside each of the side walls 36 thereof. The fixed stop bars 56 are supported on cross bars 62 anchored at their opposite ends in the furnace side walls 36.

When the rest bars 54 are elevated a sufficient distance by the lift bars 60 to raise the rows 22 of workpieces W in the cradles 52 above the rest edges of the fixed stop bars 56, the workpieces of each row then roll or slide down onto the top of the respective fixed stop bar and against the edge of the next adjacent movable rest bar 54. On subsequent downward return of the rest bars to their lowered cradle-forming position, the workpieces then roll down onto the top of and rest on such next adjacent movable rest bar 54 within the cradle 52 formed thereby. Thus, the rows 22 of workpieces W in each cradle 52 are progressively advanced step-by-step from one cradle to the next through the furnace chamber. From the last one of the cradles 52 in the furnace, the row 22 of workpieces therein roll off the fixed stop bar 56 of such last cradle and into a horizontally extending V-section feed-out trough 64, in position for discharge from the furnace F through a discharge opening 66 (FIGS. 1 and 3) of minimal size.

The vertical reciprocation movement of the lift bars 60 to advance the rows 22 of workpieces W from one cradle 52 to the next is produced by suitable elevator mechanism 70 of the workpiece transport mechanism 50. As shown particularly in FIG. 4, elevator mechanism 70 comprises respective pairs of vertically extending elevator rods 72 connected to and supporting the opposite ends of respective ones of the lift bars 60. Elevator rods 72 extend through the bottom wall 40 of furnace housing 30 and are supported for vertical reciprocation movement in slide bearings 74 mounted on furnace support frame 76. Elevator rods 72 engage and rest at their lower ends against respective edge cams 78 all of the same cam edge shape and fixed in corresponding oriented position on horizontal parallel cam shafts 80 which extend transversely to lift bars 60 and are journaled at their opposite ends in brackets 82 extending from furnace frame 76. Drive arms 84 of the same form and fixed one on each shaft 80 in corresponding oriented position thereon are pivotally connected at their outer or free ends to one end of respective horizontally extending drive rods 86 which are pivotally connected at their other ends to the opposite ends of a horizontally extending common piston rod 88 extending outwardly from each end of a hydraulic cylinder 90 mounted on furnace frame 76. Actuation of the cylinder 90 in one direction rotates the cams 78 so that the rise portions thereof raise the elevator rods 72 and lift bars 60 in unison which then raise the rest bars 54 of the workpiece cradles 52 to their elevated position to cause the workpieces therein to roll down off the cradle rest bars 54 and onto the fixed stop bars 56 of the cradles in position to roll down into the next forward one of the cradles 52 when formed by the subsequent lowering of the rest bars 54 to their lower position by the operation of the cylinder 90 in the opposite direction. The operation of the cylinder 90 of the transport mechanism 50 to effect the step-by-step advance of the rows 22 of workpieces through the preheating furnace F may be controlled either manually or automatically, for example, in response to an electrical signal signifying that the feed-out trough 64 of the furnace F is empty of workpieces. The duration of the step-by-step advance movement of the workpieces through the furnace F is regulated so that the workpieces will be at the desired preheat temperature $T_1$ of, for example, around 1200° F. in the case of brass or copper nonmagnetic workpieces, by the time they are released into the feed-out trough 64 of the furnace.

On reaching the feed-out trough 64, the now preheated workpieces at temperature $T_1$ are discharged one at a time therefrom and out of the furnace F through the discharge opening 66 thereof and substantially immediately transferred into and advanced in step-by-step fashion through the induction heating coil C to effect the inductive post-heating of the workpieces to their selective processing or forging temperature $T_2$.

The discharging of the preheated workpieces one at a time from the feed-out trough 64 of the furnace F may be accomplished by any suitable means as by a push rod 92 (FIG. 3) extending through and reciprocable within an opening in the furnace side wall 36 and aligned with the row 22 of workpieces in the feed-out trough 64. The push rod 92 may be operated either manually or, as shown, automatically as by means of a hydraulic cylinder 94, the piston rod of which serves as the push rod 92 and is adapted to advance slowly or in progressive steps on its workpiece feed-out stroke so as to discharge the workpieces one at a time from the feedout trough 64 and in substantial timed sequence with the discharge from the heating coil C of a workpiece which has been post-heated therein to the selective forging temperature $T_2$.

On being pushed out of the furnace discharge opening 66 by the push rod 92, each preheated workpiece drops into and slides down a downwardly tilted chute 96 into and in axially aligned relation with a horizontally extending guide trough 98 leading into the open feed-in end of and aligned with a workpiece receiving passageway 100 in the induction heating coil C, in readiness for introduction of the workpiece thereinto. As shown in FIG. 3, induction heating coil C is of a conventional multiturn type comprising a hollow electrical conductor helically coiled in a plurality of convolutions 102 about a linear coil axis and connected at its opposite ends to a coolant inlet 104 and a coolant outlet 106 which are connected to a supply (not shown) of a suitable coolant. Inlet and outlet 104 and 106 form spaced connector leads for connecting the full length of the coil by means of electrical circuit 108 across an appropriate high frequency AC power supply, schematically illustrated as a generator 110, to continuously energize the coil C during the operation of the apparatus. The convolutions 102 of the heating coil C are shown embedded in a body of refractory material 112 formed with the elongated central workpiece receiving passageway 100 extending coaxially with the central coil axis. The coil passageway 100 is provided with workpiece supporting slide rails 114 (FIGS. 1 and 5) extending therethrough and along which the workpieces slide during their travel through the coil passageway.

As each preheated workpiece W slides down chute 96 and into guide trough 98, it is immediately moved into the open feed-in end of the passageway 100 of the continuously energized coil C to initiate the inductive post-heating of the workpiece. During its feed-in movement into the coil passageway, the inserted workpiece abuts against the last one of the workpieces previously introduced into the passageway and pushes ahead the entire row of workpieces present therein a sufficient distance, corresponding to the length of one of the workpieces, to eject the forwardmost one of the workpieces in the workpiece row out of the other or discharge end of the coil passageway, the ejected workpiece having been post-heated by that time to the selective processing or forging temperature $T_2$. The row of workpieces W in the coil passageway 100 thus are advanced step-by-step therethrough and progressively post-heated therein by the energized coil C until they reach the selective processing or forging temperature $T_2$ at the outlet or discharge end of the passageway 100, at which time they are ejected therefrom. The sliding movement of the workpiece W from the guide trough 98 into the coil passageway 100 may be effected by a push rod 116 which may comprise the piston rod of a hydraulic cylinder 118 mounted beneath the chute 96 on the furnace frame 76, with the piston rod 116 aligned with the workpiece W in the guide trough 98 and with an opening 120 in the chute 96 through which opening the piston rod reciprocates on actuation of the cylinder 118.

Actuation of hydraulic cylinder 118 to effect the introduction of the preheated workpiece from the guide trough 98 into coil passageway 100 occurs as soon as the forwardmost workpiece in the row thereof in the coil passageway reaches the selective processing or forging temperature $T_2$ as determined, for example, by a temperature sensor 122 such as an infrared detector or optical pyrometer. The sensor is mounted opposite a window or sight opening 124 in the refractory body 112 of the induction heating coil C between windings 102 thereof to sense through this opening the temperature of the forwardmost one of the workpieces in the coil passageway 100 at the last one of the step-by-step heating positions therein prior to ejection from the coil passageway. The temperature sensor 122, being set at a predetermined temperature setting corresponding to the desired selective processing or forging temperature $T_2$ of the workpiece, provides an electrical signal which controls the operation of the workpiece feed-in cylinder 118, as through a solenoid operated valve for example, to introduce another workpiece at the preheat temperature $T_1$ into the coil passageway 100 and simultaneously effect the ejection therefrom of the forwardmost workpiece in the passageway which has been determined by the sensor 122 to be at the selective processing or forging temperature $T_2$. The ejected workpiece W from the coil passageway 100 then rides onto a continuously rotating drive roller 126 driven by an electric motor-speed reducer unit 128 to further carry along the ejected workpiece and deposit it into a suitable receptacle or collector chute 130 for removal as by a forging press operator.

From the above description, it will be apparent that the apparatus according to the invention operates either in a manually or an automatically controlled manner to provide a substantially continuous supply of workpieces W of nonmagnetic metal heated to an elevated processing or forging temperature $T_2$ by the highly efficient two-stage heating process comprising the invention and, most importantly, without adversely affecting the surface condition of the workpieces by surface degradation or grain coarsening. By using the method and apparatus comprising the invention, a heating system is provided having a greatly increased efficiency amounting to around 60% as compared to the normal 30% to 35% efficiency of prior heating systems which, in order to avoid surface degradation or grain coarsening of nonmagnetic metal workpieces, heat the workpieces to their forging temperature $T_2$ entirely by the use of induction heating. A savings of approximately 50% in electrical energy over such completely inductive heating processes is thereby realized.

The invention has been described with reference to a preferred embodiment. Obviously, modifications and alterations will occur to others upon the reading and understanding of this specification. It is my intention to include all such modifications and alterations insofar as they come within the scope of the appended claims or the equivalents thereof.

Having thus described the invention, it is claimed:

1. The method of heating a workpiece of nonmagnetic metal material having an initial temperature to a selective elevated processing temperature comprising the steps of:

(a) first preheating the said workpiece in a high efficiency electric radiant heat furnace to a preheat temperature elevated above said initial temperature by more than one half the difference between said initial temperature and said processing temperature and said preheat temperature being substantially below said processing temperature of the workpiece so as not to cause undesired surface degradation and grain coarsening thereof, and (b) then transferring the said preheated workpiece from said furnace immediately into and post-heating said preheated workpiece inductively in an induction heating coil to said selective processing temperature.

2. The method as defined in claim 1, wherein the said preheating of the workpiece is to a preheat temperature at least around 200° F. below the said selective processing temperature.

3. The method as defined in claim 1, wherein the said preheating of the workpiece is to a preheat temperature expressed in degrees Fahrenheit in the range of around 80% of the temperature in degrees Fahrenheit of said selective processing temperature.

4. The method as defined in claim 1 for heating a workpiece of brass material to a forging temperature in the range of around 1500° F. wherein the said preheating of the workpiece is to a preheat temperature in the range of around 1200° F.

5. The method as defined in claim 1, wherein a plurality of the said workpieces are progressively preheated to the said preheat temperature in said electric radiant heat furnace and, approximately as soon as they attain the said preheat temperature, are transferred in succession one at a time from said furnace immediately into and post-heated in said induction heating coil to said selective processing temperature.

6. The method as defined in claim 1, wherein parallel side-by-side rows of said workpieces are progressively advanced transversely in step-by-step fashion through said furnace while progressively preheated therein to said preheat temperature, and wherein the workpieces in each of said rows thereof, upon attaining their said preheat temperature, are transferred in succession, one at a time, from said furnace immediately into and post-heated in said induction heating coil to said selective processing temperature.

7. Apparatus for heating a workpiece of nonmagnetic metal having an initial temperature to a selective processing temperature comprising a slot-type high efficiency electric radiant heat furnace for preheating the workpiece to a preheat temperature elevated above said initial temperature by more than one half the difference between said initial temperature and said processing temperature and said preheat temperature being below said selective processing temperature, conveyor means associated with said furnace for conveying the said workpiece therethrough to a discharge position therein at which the workpiece is at said preheat temperature, an induction heating coil located adjacent said furnace and having a workpiece receiving coil passageway therethrough, transfer means cooperating with both said furnace and said induction heating coil for transferring the said preheated workpiece from the said discharge position thereof in said furnace substantially immediately into and through the said passageway of said induction heating coil, and a high frequency electrical power supply for energizing said induction heating coil, while the said preheated workpiece is moved through said coil passageway, to inductively post-heat said preheated workpiece to the said selective processing temperature.

8. Apparatus as defined in claim 7 and including a support guide for receiving the said preheated workpiece from the furnace and aligning it with the entrance end of said coil passageway, and wherein the said transfer means includes a first hydraulic cylinder actuated push rod for engaging and discharging the said preheated workpiece from the furnace into said support guide and a second hydraulic cylinder actuated push rod for engaging and pushing the said preheated workpiece from said support guide into said coil passageway and progressively therethrough.

9. Apparatus as defined in claim 7, wherein said transfer means transfers a said preheated workpiece from said furnace into said coil passageway while substantially simultaneously ejecting another of said workpieces from said coil passageway on post-heating therein to said processing temperature.

10. Apparatus as defined in claim 7 and including a temperature sensor for sensing the temperature of the postheated workpiece in said coil passageway and transmitting an operating signal to said transfer means, on sensing the said processing temperature of said workpiece in said passageway, to effect the actuation of said transfer means to transfer another said preheated workpiece from said furnace substantially immediately into said coil passageway and at the same time eject therefrom the said post-heated workpiece at said processing temperature.

11. Apparatus as defined in claim 8 and including a temperature sensor for sensing the temperature of the post-heated workpiece in said coil passageway and transmitting an operating signal to said first hydraulic cylinder actuated push rod, on sensing the said processing temperature of said post-heated workpiece, to discharge a said preheated workpiece from said furnace into said support guide and cause actuation of said second hydraulic cylinder actuated push rod to push said preheated workpiece from said support guide into said coil passageway and at the same time eject therefrom the said post-heated workpiece at said processing temperature.

* * * * *